US005684453A

United States Patent [19]

Welch

[11] Patent Number: 5,684,453

[45] Date of Patent: Nov. 4, 1997

[54] BASKETBALL TRAINING APPARATUS

[76] Inventor: Scott A. Welch, 140 Bouchelle Rd., North East, Md. 21901

[21] Appl. No.: 640,594

[22] Filed: May 1, 1996

[51] Int. Cl.[6] ..... G08B 23/00

[52] U.S. Cl. ..... 340/323 R; 473/433; 473/479; 364/411

[58] Field of Search ..... 340/323 R, 323 B, 340/665; 364/411; 273/1.5 R, 1.5 A; 473/433, 479

[56] References Cited

U.S. PATENT DOCUMENTS

| | | | |
|---|---|---|---|
| 3,898,639 | 8/1975 | Muncheryan | 340/692 |
| 4,703,445 | 10/1987 | Dassler | 340/323 R |
| 4,904,981 | 2/1990 | Mele et al. | 340/323 R |
| 4,956,775 | 9/1990 | Kiamer et al. | 364/411 |
| 4,972,171 | 11/1990 | Johnson et al. | 340/323 R |
| 4,999,603 | 3/1991 | Mele et al. | 340/323 R |
| 5,039,977 | 8/1991 | Mele et al. | 340/323 R |
| 5,341,121 | 8/1994 | Rada | 340/323 R |
| 5,549,293 | 8/1996 | Seifert | 273/1.5 R |

*Primary Examiner*—Jeffrey A. Hofsass
*Assistant Examiner*—Daniel J. Wu
*Attorney, Agent, or Firm*—Robert E. Bushnell, Esq.

[57] ABSTRACT

An electronic basketball training apparatus that instructs a player to move to a sequence of zones and allows the player a limited amount of time to make a basket in each zone. The apparatus computes results and statistics which can be printed out or viewed from a computer screen. The invention can have the computer automatically communicate or allow a coach to communicate the next zone to the player. The invention uses a switch sensor in the basketball net to sense when a basket is made, laser beam sensors on the floor to locate the position of the player, a controller, memory, software, a visual display terminal, a printer, and a speaker to perform the training routine.

20 Claims, 5 Drawing Sheets

BASKETBALL TRAINING APPARATUS

FIELD OF THE INVENTION

This invention relates to an automated electronic basketball training apparatus. This invention pertains to an electrical communications game monitoring unit that is used for training players in ID basketball.

BACKGROUND OF THE INVENTION

Electronic sensors sense the passage of a basketball through a basket while light sensors sense the location of a player on the basketball court. A controller receives signals from these sensors and runs a training routine accordingly.

The use of sensors for basketball may be found in such references as U.S. Pat. No. 5,039,977 (Mele'977) and 4,904, 981 (Mele'981), where sensors detect whether a basketball passes through a basket. Mele'977 also uses a pressure sensor on the floor to determine if the player is in the proper spot when shooting a basket. Mele'977 will not award points to a basket made unless the player is simultaneously standing on the pressure sensor when a basket is made. Mele'977 and Mele '981 can detect shots attempted via sensors in the backboard and, through a control unit, can compute statistics showing the percentage of shots made.

In addition to detecting when a basket is made and when a basket was attempted, U.S. Pat. No. 4,999,603 (Mele'603) detects the location on a basketball court from where the basketball was thrown by using a plurality of laser beam generators and receivers to form a laser beam grid across an entire basketball court, with the distance between adjacent parallel laser beams being smaller than the diameter of a basketball. Mele'603 feeds raw data from the laser grid to a controller which can calculate the exact location from where the ball was thrown. By being able to determine the exact location of where a basketball was thrown, the controller can automatically award the proper number of points for each successfully completed basket. The controller is also capable of computing statistics and results. A visual display and printer are connected to the controller to display these results, a speaker is connected to the controller for audio communication. Mele'603 lacks sophisticated software to run a training routine for a basketball player. Instead, Mel'603 awards points for all baskets made from the basketball court.

U.S. Pat. No. 4,972,171 to Johnson shows a device that detects an illegal pitch in softball by detecting whether the ball exceeds twelve feet in height. A single laser emitter is attached to a detector placed on a backstop twelve feet above the ground. The narrow beam is converted into a broad fan-shaped beam. If the ball exceeds twelve feet, the detector will detect the emitted light reflected off the softball. Only when this reflected light is detected by the sensor will the device become aware that the ball has crossed into the illegal zone. Johnson does not sense when a home run or a base hit is made, and Johnson does not incorporate a training routine for the player.

SUMMARY OF THE INVENTION

It is therefore an object of this Invention to provide a program and apparatus that combines the excitement and fantasy of a game wit the skill of playing on a basketball court.

It is another object of this invention to provide an improved basketball training device and process.

It is yet another object to provide an automatic basketball training device for use by one player on one side of a basketball court requiting the player to move to and shoot baskets from various zones within a limited period of time.

It is still another object to provide a programmable self-automated training device for a basketball player that can compute statistics, results and evaluate performance of the basketball player.

It is yet another object to provide an automated training device that can instruct the player where to go by automated commands.

It is still yet another object of this invention to provide for an infinite amount of training routines for a basketball player by adjusting the sequence of locations that a player must shoot from.

It is yet further an object of this invention to provide an infinite combination of training routines by allowing for an infinite arrangement of the laser emitters and laser relays that delineate the size, shape, and location of each of the zones the player must shoot from.

These and other objects may be achieved with the automated basketball training apparatus of the present invention. A player is told to move to a sequence of locations on a basketball court and to shoot a basket from each location within a limited amount of time. Results and statistics of the player's performance are calculated and printed at the end of a training session. Laser sensors detect the passage of a basketball through a basket, and detect the approximate location of a player on a basketball court. A controller instructs the player of the location that the next shot is to be taken from and keeps a record of shots successfully made and computes and prints statistics of a training session upon completion by a player. Points are awarded only when the player makes a basket, when the player shoots from the proper location, and when the shot clock has not expired.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
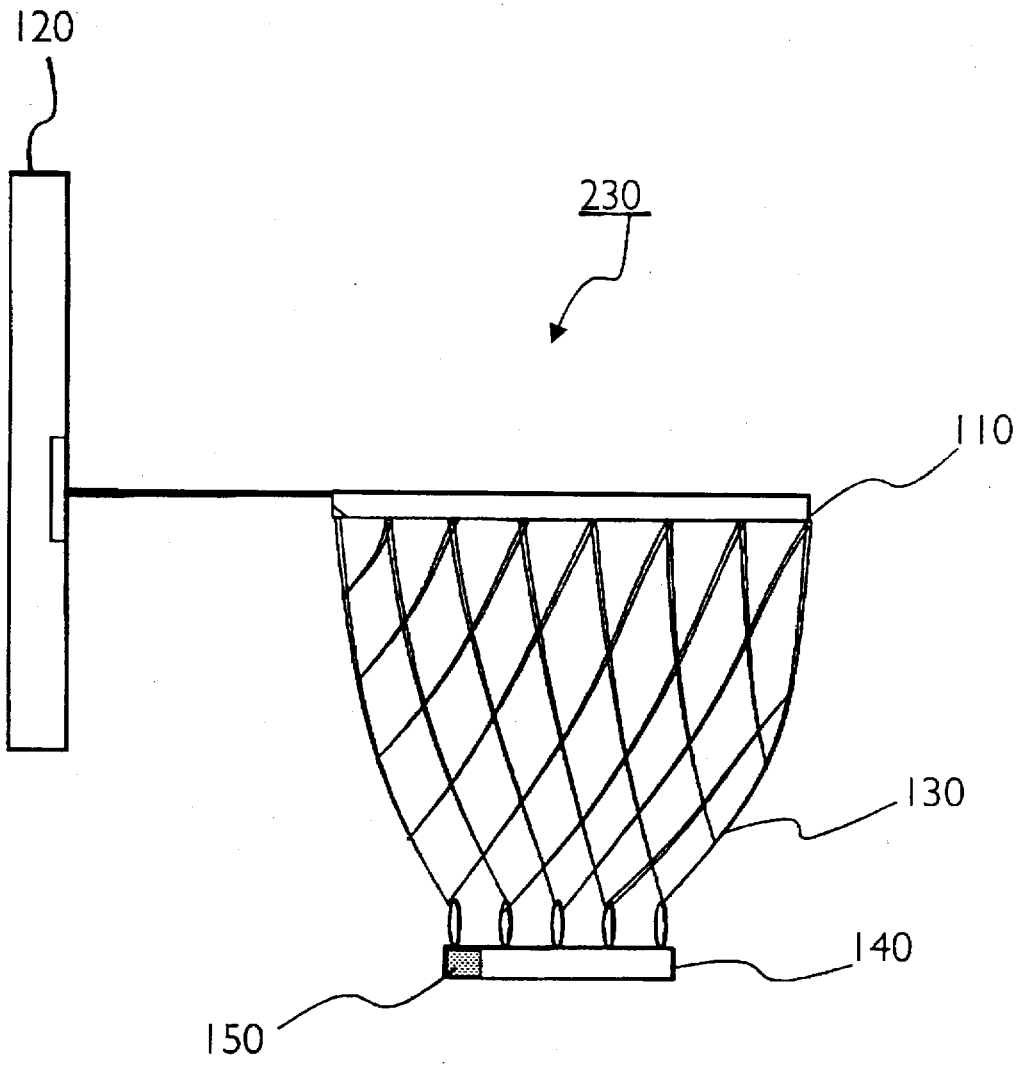
FIG. 1 is a side view of a basket used in the practice of the present invention showing the micro switch used to signal the controller of the passage of a basketball through the basket.

Turning now to the drawings, FIG. 1 shows basket 230. The basket consists of a backboard 120 that allows a player to score a goal by bouncing off backboard 120, hoop 110 which defines the goal through which the ball must pass through, net 130 which slows the velocity of the ball when a basket is scored, PVC ring 140 which denotes the bottom or tapered portion of the net through which the ball passes through after a goal has been scored, and a sensing switch 150 that produces an electronic signal to notify the controller that a basket was made.

Figure 2:
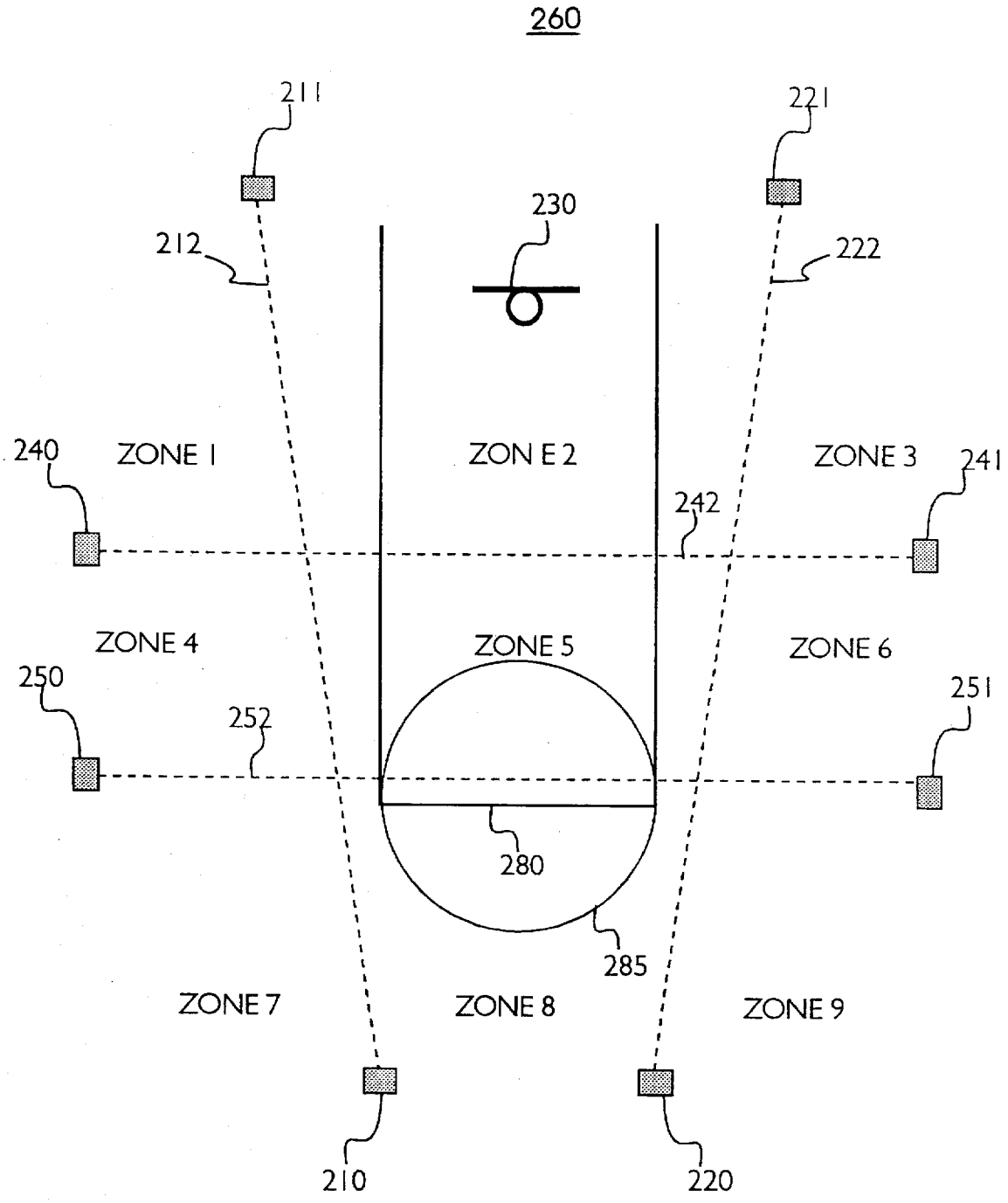
FIG. 2 is a top view of the portion of a basketball court used in the practice of the present invention, showing the different zones defined by a grid of laser beams.
Figure 3:
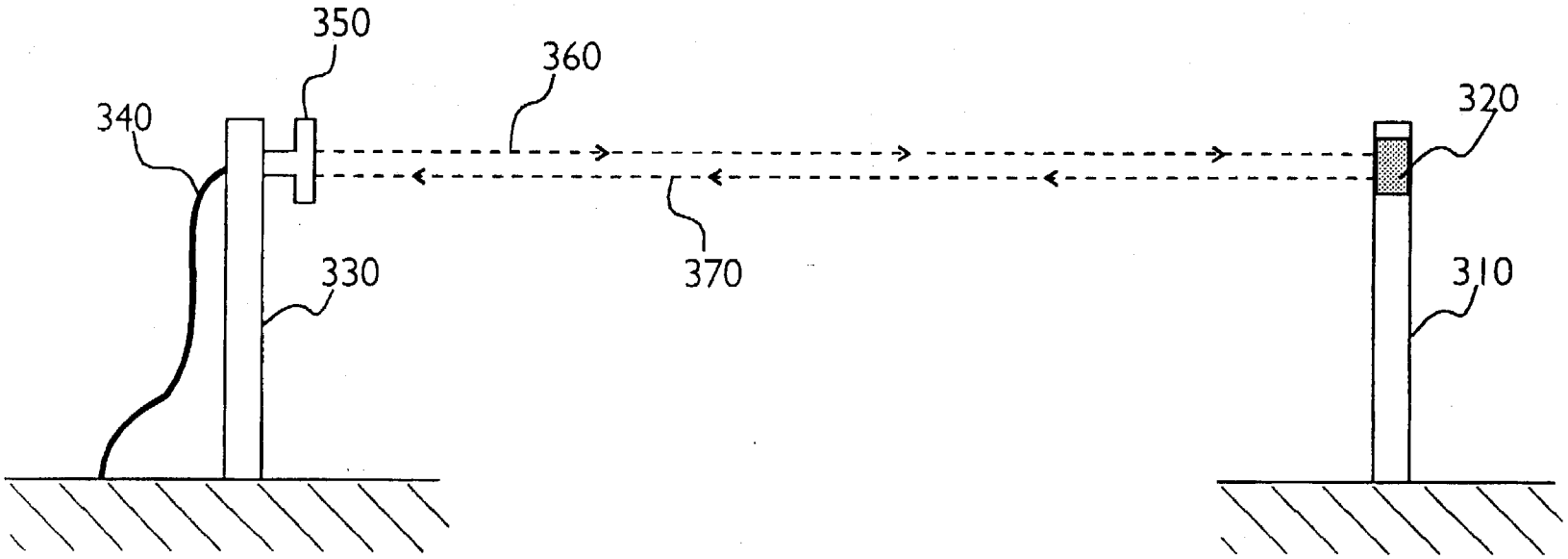
FIG. 3 is a side view of a single laser sensor unit showing the relay on the right and the emitter and detector on the left.

FIG. 2 shows basketball half court 260 with basket 230. Foul throw line 280 is illustrated as is key 285. Four dashed lines 212, 222, 242, and 252 shown in FIG. 2 denote spaced-apart infrared laser beams. An expanded view of an individual laser beam is shown in FIG. 3. Relay unit 320 mounted on post 310 reflects laser beam 360 back to the combined emitter and detector units 350 mounted on post 330. FIG. 2 shows four relays 211, 221, 241, 251 and four combined emitter and detector units 210, 220, 240, and 250 which produce and detect beams 212, 222, 242, and 252 respectively. The beams are situated to divide the playing area on the court into 9 separate zones. As seen in FIG. 2, in order for a player to get from one zone to another while remaining within the playing area on the court, at least one beam must be broken.

Figure 4:
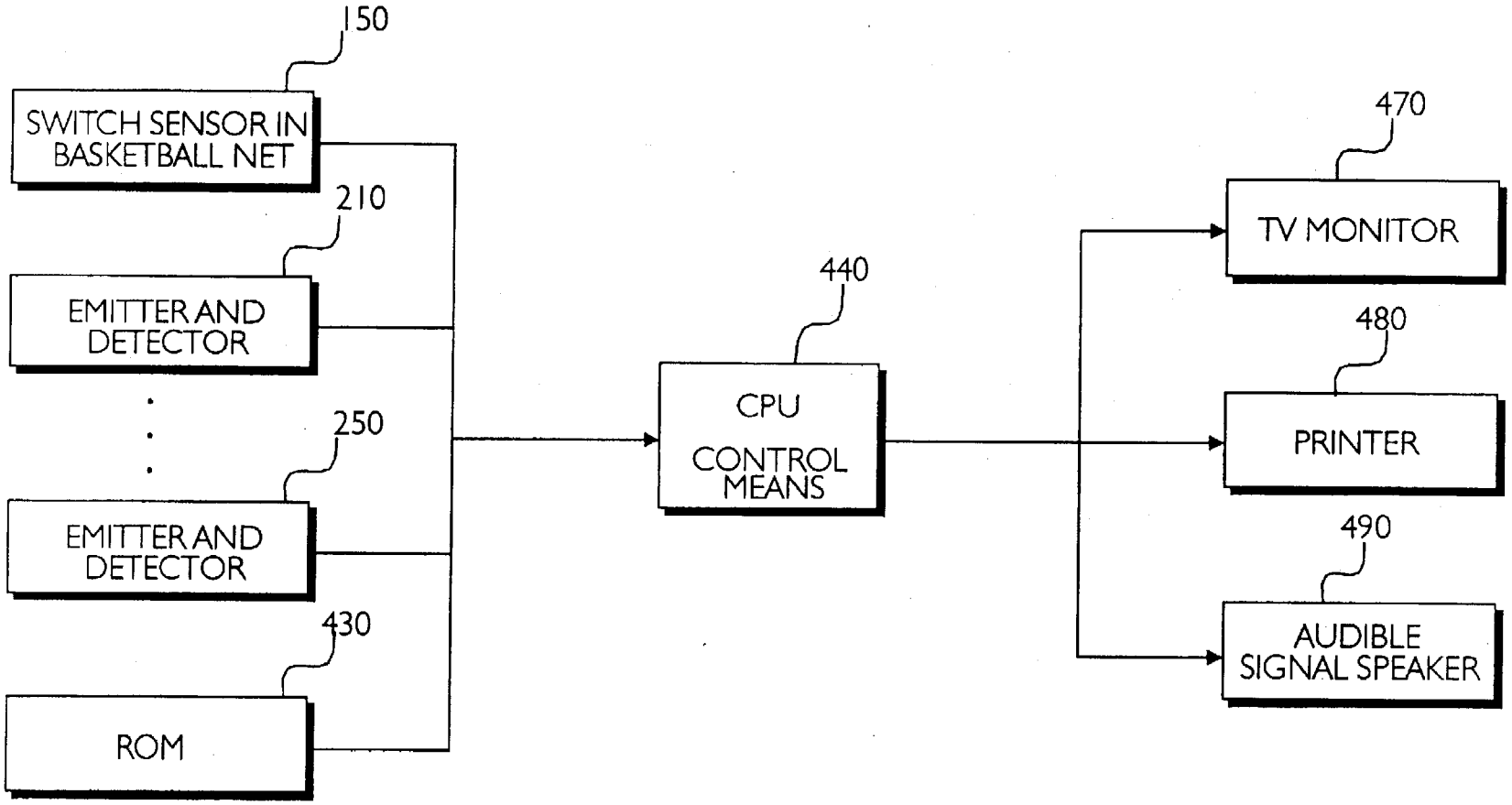
FIG. 4 is a block diagram showing the flow of information generated in the practice of the present invention relative to the controller.

Turning to FIG. 4, controller 440 lies at the heart of the invention. Signals from the switch sensor 150 on the basketball net, along with signals from the four laser detectors 210, 220, 240, and 250 are fed into the controller 440. During the operation of a training session, controller 440 executes a software program from KOM 430 which supplies the sequence of zones that the player must shoot from. In one embodiment, an audible speaker 490 tells the player which zone to move to next. In the second embodiment, a coach communicates to the player the next zone number. In either embodiment, when the training session is complete, the results and statistics can be displayed on visual monitor 470 or be printed out on printer 480 attached to controller 440.

Figure 5:
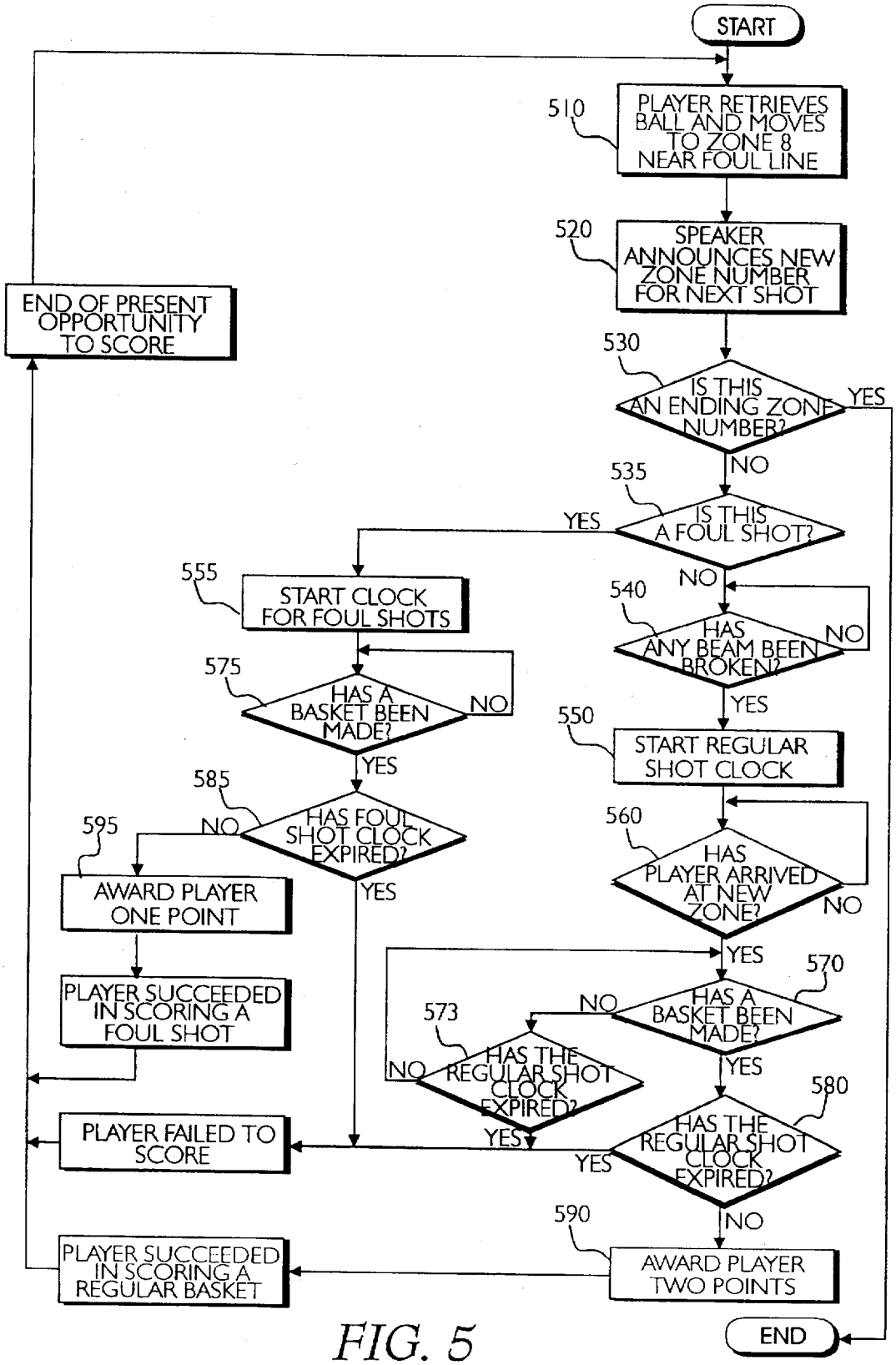
FIG. 5 a flow chart of the training process during the execution of a training session.

The flow chart in FIG. 5 and the algorithm in the appendix illustrate how the training session of the present invention combines the skill of basketball playing with the fantasy and excitement of a game. As shown in FIG. 5, the computer may instruct the player to either move to a one point foul shot or to a regular two point shot. The right column in FIG. 5 pertains to regular two point shots, while the short left column pertains to one point foul shots.

To begin, the player starts each shot opportunity in zone 8 with the ball in possession 510. Zone 8 is the zone that encompasses the foul throw line 280. With the player and the ball in this initial state, speaker 490 connected to controller 440 announces 520 from what zone the player is to shoot from and whether the shot is a foul shot. The zone number and the type of shot are randomly determined by the controller. If the next shot is a two point shot, the player begins to move causing a beam to be interrupted 540 by the player's body. This first interruption starts the two point shot clock which limits the amount of time the player has to make a basket at the new zone 550. The remainder of the algorithm ensures both that the player is in the proper zone 560 when the basket was made 570 and that the shot clock has not expired 580 when the basket is made before awarding points 590 to a successfully completed basket. Since the player always starts from zone 8, FIG. 2 illustrates what beams must be broken for the player to move to the proper zone. Only when all of the required beams have been broken and when the shot clock has not expired will the controller award points for a successfully completed basket. Because the player is generally given three to four seconds to make a regular two point shot, it is unlikely that the player will have an opportunity to make a second attempt before time expires. When the player either scores, or when the shot clock runs out, the program gives the player eight or nine seconds to retrieve the ball and return to zone 8 before announcing the zone number for the next shot.

The algorithm is also capable of awarding one point for foul shots. Foul shots, like all other shots, are randomly selected by the computer and are communicated to the player as foul shots. A special foul shot clock gives the player additional time than would otherwise be afforded if it was for two points. Because the player is already in the zone for the foul shot when a foul shot is announced, the player does not cross between zones and interrupt any beams during a foul shot opportunity. Thus, the foul shot clock is initiated upon announcement, not upon movement by the player. The controller automatically awards just one point for a foul shot basket successfully completed.

The invention may be embodied in forms other than those disclosed above without departing from the spirit or essential characteristics of the invention. For example, a second embodiment of this invention is to have a coach, instead of the speaker, communicate the zone locations to the player. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced within.

APPENDIX

```
Computer code for the algorithm of FIG. 5 for the basketball training device:
Start
X=O   ! X is the number of possible points
Y=O   ! Y is the number of points scored
Read A[x]      ! Next zone number is determin ed randomly
Write A[x]     ! Next zone number is announced over the speaker
If A[x] = foul shot, then Goto 180 ! If next shot is a one point foul shot
If A[x] = 0, then Goto 200 ! It zone number is an ending zone number, end program
X=X+2          Player has the opportunity to score two points
If A[x] = A[x--1], then Goto 150    ! If player does not have to move for next shot
Do
Until any beam is broken       ! Do nothing until player moves to a new zone
Start regular two point shot clock countdown
Do
Until all required beams have been broken !Do nothing until player reaches new zone
    ! Player has arrived at new zone
```

-continued

APPENDIX

```
        Do
            If regular two point shot clock expires, then Goto 190     ! If time has expired, go to next
zone
        Until player scores a basket
            ! Player made basket within time from proper zone
        Y=Y+2        ! Player is awarded two points for successful basket
        Goto 190     ! Retrieve ball, go back to starting zone and listen for next zone number
180     Start foul shot clock countdown
        X=X+1        ! Player has the opportunity to score just one point
        Do
            If foul shot clock expires, then Goto 190
        Until player scores a basket
        Y=Y+1        ! Player is awarded one point for successful foul shot
190     Do
            Nothing      ! There is an 8 second delay for player to retrieve ball and
        Until 8 seconds elapses ! Return to zone 8 before the next command is announced
        Goto 100
200     End     ! End training session
```

What is claimed is:

1. An electronic training apparatus, comprised of a switch sensor on a basket positioned to provide first signals indicative of passage of a ball through said basket;

a plurality of light beam sensors distributed in an ordered array dividing a basketball court into a plurality of contiguous zones defined by said array, to generate positional signals indicative of positions of a player on said court; and control means for generating an audible signal assigning the player to one of said zones for a subsequent shot, for automatically determining said position of said player on said court in response to said positional signals, and for computing results and statistics on a basis of said position in response to said first signals.

2. The electronic training apparatus of claim 1, further comprising a time clock delineating a time interval accorded to a player to shoot from said one of said zones.

3. The electronic training apparatus of claim 1, further comprising said control means that generates a sequence of said zones the player must shoot from.

4. The electronic training apparatus of claim 1, further comprising display means for automatically varying a display of visual representations in accordance with said results and statistics.

5. The electronic training apparatus of claim 1, further comprising means for printing said results and statistics.

6. The electronic training apparatus of claim 1, further comprising memory means for storing a software program enabling said control unit to generate said audible signal compute said results and statistics.

7. The electronics apparatus of claim 1, further comprising memory means for storing a software program enabling said control unit to automatically determine said zones for a subsequent shot.

8. The electronic training apparatus of claim 1, further comprising means for muting said audible signal.

9. An electronic training process, comprised of:

generating an audible command directing a player to a first zone of a plurality of distinct contiguous zones defined by a plurality of light beam sensors, emitters, and relays, placed on a court, producing light beams across said court where said beams form the boundaries of a plurality of zones on said court, said emitters, sensors, and relays detecting the zone a player is located in;

starting a time clock to measure the time afforded to the player to score a basket upon a first interruption of a beam in route to said first zone; and detecting passage of a basketball through said basket.

10. The training process of claim 9, further comprised of:

computing results and statistics based upon the status of said time clock, said entry of said detection of the player into said first zone, and said detection of said passage of said basketball through said basket.

11. The basketball training process of claim 9, further comprised of generating an audible command directing the player to a second one of said zones;

detecting the entry of the player to said second one of said zones;

starting a time clock to measure the time afforded to said player to score a basket upon said first detection of player movement in route to said second zone; and detecting passage of said basketball through said basket.

12. The process of claim 9, further comprised of displaying visual representations varying in dependence upon said results and statistics.

13. An electronic training apparatus, comprised of:

a switching sensor on a basket to sense the passage of a ball through said basket;

a plurality of light beam sensors, emitters, and relays, placed on a court, producing light beams across said court where said beams form the boundaries of a plurality of zones on said court, said emitters, sensors, and relays detecting the zone a player is located in; and a control means to:

automatically determine a zone that said player is located in, and compute results and statistics in response to signals from said switch sensor.

14. The electronic training apparatus of claim 13, further comprising a control means capable of generating a sequence of zones said player must shoot from.

15. The electronic training apparatus of claim 13, further comprising a display unit for displaying said results and statistics.

16. The electronic training apparatus of claim 13, further comprising a printing unit for printing said statistics and results.

17. The electronic training apparatus of claim 13, further comprising memory means for storing a software program enabling said control unit to generate audible signals and compute said results and statistics.

18. The electronics apparatus of claim 13, further comprising memory means for storing a software program enabling said control unit to automatically determine said zone for a subsequent shot.

19. The electronic training apparatus of claim 17, further comprising means for muting said audible signals.

20. The electronic training apparatus of claim 14, where said sequence of zones said player must shoot from is comprised of a random mixture of one point foul shots and two point region basketball shots.

* * * * *